United States Patent [19]

Harada et al.

[11] Patent Number: 4,736,673

[45] Date of Patent: Apr. 12, 1988

[54] SELECTIVE CONTROL DEVICE FOR PLURAL KINDS OF OIL-HYDRAULIC ACTUATORS

[75] Inventors: Takuo Harada; Toshiaki Kurashima, both of Kojyo, Japan

[73] Assignee: Sanyokiki Kabushiki Kaisha, Hyogo, Japan

[21] Appl. No.: 868,066

[22] Filed: May 29, 1986

[30] Foreign Application Priority Data

Jun. 20, 1985 [JP] Japan ..... 60-94039[U]

[51] Int. Cl.[4] ..... F15B 11/00; F15B 13/00

[52] U.S. Cl. ..... 91/522; 91/526; 91/527; 91/436

[58] Field of Search ..... 91/522, 526, 527, 531, 91/436, 440, 450

[56] References Cited

U.S. PATENT DOCUMENTS

| | | | |
|---|---|---|---|
| 2,367,682 | 1/1945 | Kehle | 91/436 |
| 3,228,306 | 1/1966 | Pederson | 91/436 |
| 3,241,461 | 3/1966 | Drone | 91/436 |
| 3,304,633 | 2/1967 | Hein et al. | 91/522 X |
| 3,357,451 | 12/1967 | Tennis | 91/436 X |
| 3,796,232 | 3/1974 | Dalton | 91/436 X |
| 4,487,106 | 12/1984 | Field, Jr. | 91/436 |
| 4,610,193 | 9/1986 | Barker et al. | 91/436 X |

FOREIGN PATENT DOCUMENTS

| | | |
|---|---|---|
| 59-34721 | 9/1984 | Japan . |
| 60-154454 | 10/1985 | Japan . |
| 2057580 | 4/1981 | United Kingdom . |

*Primary Examiner*—Robert E. Garrett
*Assistant Examiner*—Mark A. Williamson
*Attorney, Agent, or Firm*—Schwartz, Jeffery, Schwaab, Mark, Blumenthal & Evans

[57] ABSTRACT

In a selective control device for plural kinds of oil-hydraulic actuators comprising an actuator selective valve for selecting an operative oil-hydraulic actuator from among plural kinds of oil-hydraulic actuators and a directional control valve for operating the selected actuator extendedly and retractedly, the actuator selective valve is provided with a quick extensional position which functions to connect an extensional pressure port thereof to a bottom side oil chamber of the selected actuator and also to connect a head side oil chamber to the bottom side oil chamber in order to extend the selected actuator quickly. The construction of the actuator selective valve eliminates a quick extensional valve adopted in a prior oil-hydraulic control device.

9 Claims, 6 Drawing Sheets

PRIOR ART Fig. 11

SELECTIVE CONTROL DEVICE FOR PLURAL KINDS OF OIL-HYDRAULIC ACTUATORS

BACKGROUND OF THE INVENTION

1. Field of the Invention

The present invention relates generally to an oil-hydraulic control device for selectively operating plural kinds of oil-hydraulic actuators and, more particularly, to an oil-hydraulic control device for selecting a specific oil-hydraulic cylinder to be operated from among plural kinds of oil-hydraulic actuators by a selective valve, extending and retracting it by a directional control valve and extending it quickly by a quick extensional valve.

2. Related Technology and Prior Art

One of the inventors of the present invention has already proposed the No. 1 related technology Japanese Provisional Utility Model Publication No. 60-154454) as shown in FIG. 10 for the construction to operate selectively plural kinds of oil-hydraulic actuators in the above-mentioned oil-hydraulic control device.

This technology can be used for operatively driving a front loader equipped as a attachment to an agricultural tractor, and is intended to simplify the detachable connection between two oil-hydraulic cylinders and oil-hydraulic hoses by reducing the number of the hoses from four originally required to two when the front loader is equipped with detachably to the tractor. Further, in spite of requiring four long pipes for actuators used for a working attachment provided remotely from a control cab in a tractor, it is intended to manage with two pipes.

The construction according to the No. 1 prior technology is as follows. That is, an arm cylinder 105 and a bucket cylinder 106 are adapted to be selectively connected to an oil-hydraulic pump 101 through a directional control valve 102, a self-sealing coupling 103 and an actuator selective valve 104 arranged in series thereto. The operative cylinder is selected from both cylinders 105,106 by the actuator selective valve 102. And then the selected cylinder 105 or 106 is operated extendedly or retractedly by the directional control valve 102.

Further, in the oil-hydraulic control device there is provided the No. 2 technology of the prior art Japanese Utility Model Publication No. 59-34721) as shown in FIG. 11 wherein disclosed is the construction to extend the oil-hydraulic cylinder quickly by a quick extensional valve.

This technology is intended to perform quickly the dump operation of the bucket of the front loader, and has the construction as follows. That is, the quick extensional valve 201 functions to retract the cylinder 202 at a normal speed when the valve 201 is returned to a returned position 204 by a returning spring 203 in the case of retracting the cylinder 202. To extend the cylinder 202 quickly, the valve 201 is switched to a quick extensional position automatically by a pilot pressure in a pilot oil passage 205 for extending the cylinder 202. At the begining of the extensional operation of the cylinder 202, when the introduction of the pressure oil into the bottom side oil chamber 207 thereof is started, the return oil from the head side oil chamber 208 changes over the quick extensional valve 201 from the retractive position 204 to the quick extensional position 206 with the pilot pressure passing through the pilot oil passage 205 due to a pressure difference generated at either side of the throttle 212 by the return oil passing through the throttle 212. Then, the return oil from the head side oil chamber 208 is supplied to the bottom side oil chamber 207 through the by-pass 209 in the quick extensional position 206. Hence, the pressure oil introduced into the bottom side oil chamber 207 from the oil-hydraulic pump drives the cylinder 202 operatively so as to be extended quickly according to the following expression.

$$V \approx Q/A$$

V; extending speed of the cylinder 202

Q; flow of the pressure oil

A; sectional area of the piston rod 210.

On the other hand, it is readily thought that the quick extensional valve device 211 of the No. 2 prior technology shown in FIG. 11 can be combined with the No. 1 technology as shown by the dot-dash line in FIG. 10. This combined construction has advantageously both merits of the No. 1 technology and the No. 2 technology, but still has the following problems. That is, (A) The quick extensional valve 201 and a special oil pressure circuit for changing over the valve 201 automatically are needed additionally. (B) During the normal speed operation except a slow speed operation regulated by the throttle 212 when the cylinder 202 is extended, since the quick extensional valve 201 always operates automatically for the cylinder 202 to be extended quickly, it becomes impossible to perform the powerful extensional operation thereof at a normal speed.

OBJECTS AND SUMMARY OF THE INVENTION

The present invention is directed to solving the problems noted above, and has for its objects to eliminate the quick extensional valve and the special circuit to change over it automatically and to enable the powerful extensional operation of the cylinder at a normal speed too when the both merits of the above mentioned prior technologies are combined.

The means of the present invention for accomplishing the above objects is a selective control device for plural kinds of oil-hydraulic actuators, wherein the No. 1 related technology shown in FIG. 10 is improved as follows.

That is, the spool of the actuator selective valve is provided with the quick extensional position for the above mentioned specific cylinder besides the selective positions for each of plural kinds of oil-hydraulic actuators. The quick extensional position is constructed so as to connect the pressure port of the actuator selective valve to the bottom side oil chamber of the specific cylinder, and also to connect the head side oil chamber thereof to the bottom side oil chamber.

Accordingly, the present invention functions as follows. That is, when the actuator selective valve is set to the position for selecting the above mentioned specific cylinder and the directional control valve is set to the extensional position, the presure oil is introduced to the bottom side oil chamber of the specific cylinder and then the return oil displaced from the head side oil chamber is returned to the oil reservoir for the specific cylinder to be operated extendedly and retractedly at a normal speed by a powerful force.

When the selective valve is set to the quick extensional position and the directional control valve is set to the extensional position, the pressure oil is introduced to the bottom side oil chamber of the specific cylinder and the return oil displaced from the head side oil chamber is introduced to the bottom side oil chamber through the quick extensional position of the selective valve so as for the cylinder to be extended quickly.

The foregoing and other objects and attendant advantages of the present invention will be readily appreciated as the same become better understood by reference to the following detailed description when considered by the accompanying drawings, wherein:

BRIEF DESCRIPTION OF THE DRAWINGS

FIG. 11 is an oil-hydraulic circuit diagram showing a principal part of No. 2 prior technology wherein an oil-hydraulic cylinder can be extended quickly by a quick extensional valve.

DESCRIPTION OF THE PREFERED EMBODIMENT

No. 1 EMBODIMENT

Figure 1:
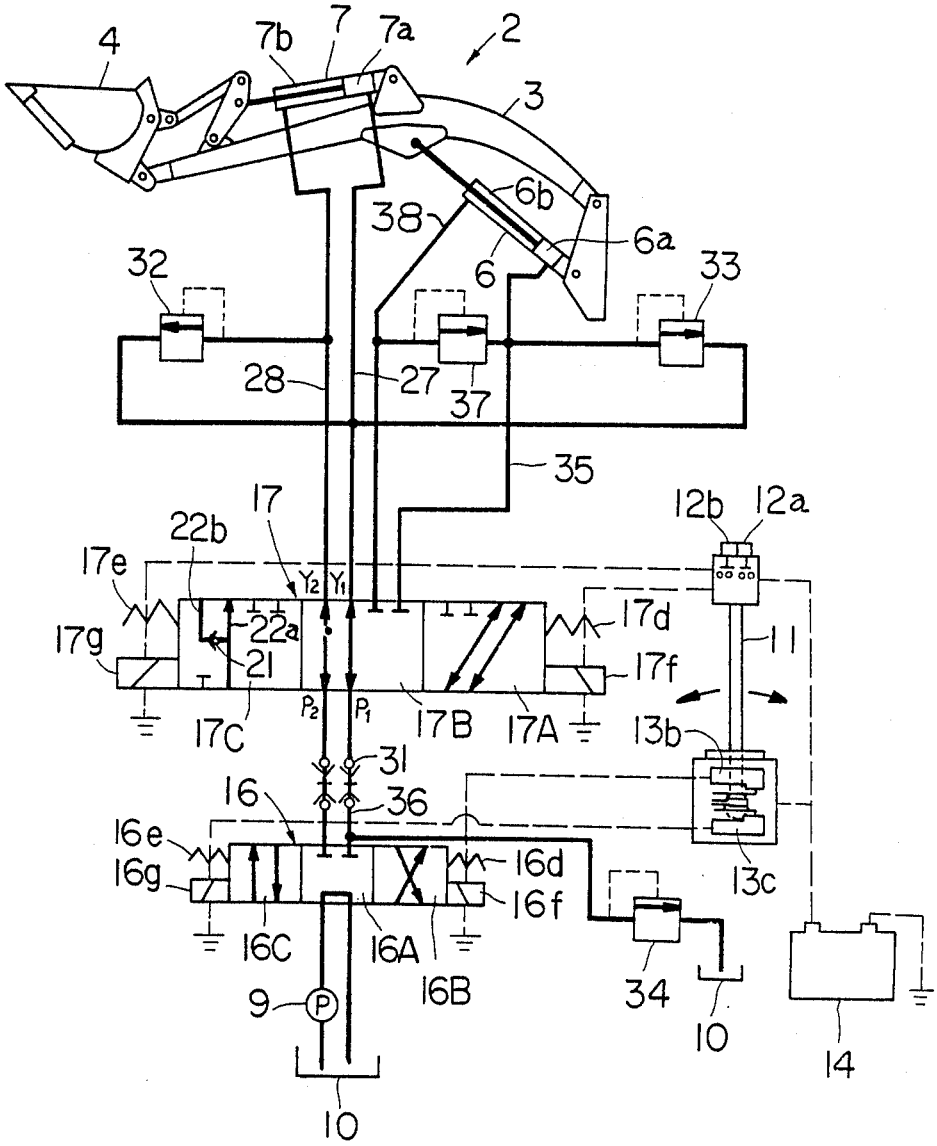
FIG. 1 is an oil-hydraulic circuit diagram showing the No. 1 embodiment wherein the present invention is applied to an agricultural front loader.
Figure 2:
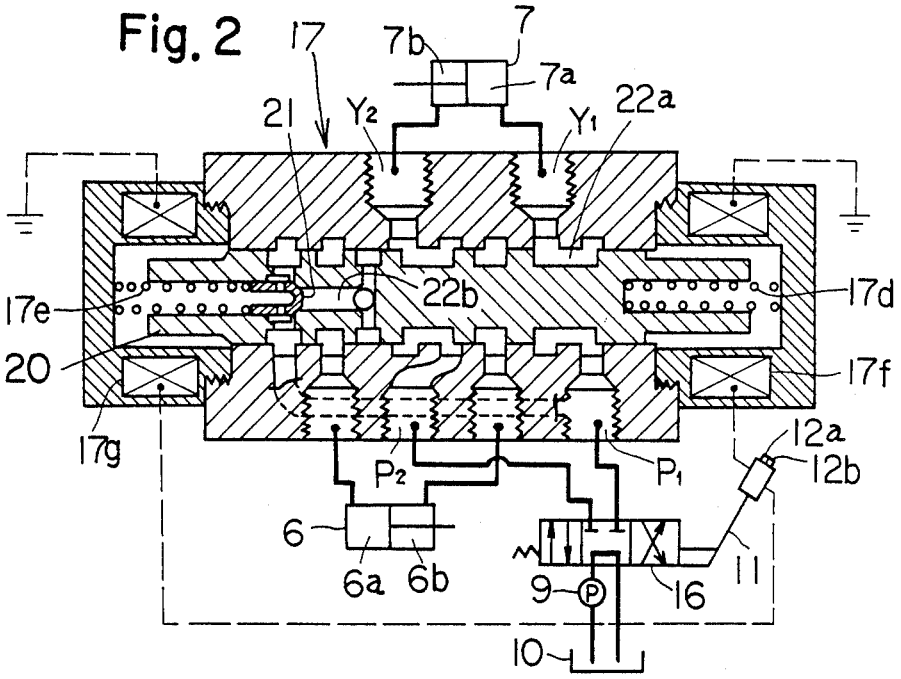
FIG. 2 and FIG. 3 are sectional views of an actuator selective valve 17 in FIG. 1 respectively.
Figure 3:
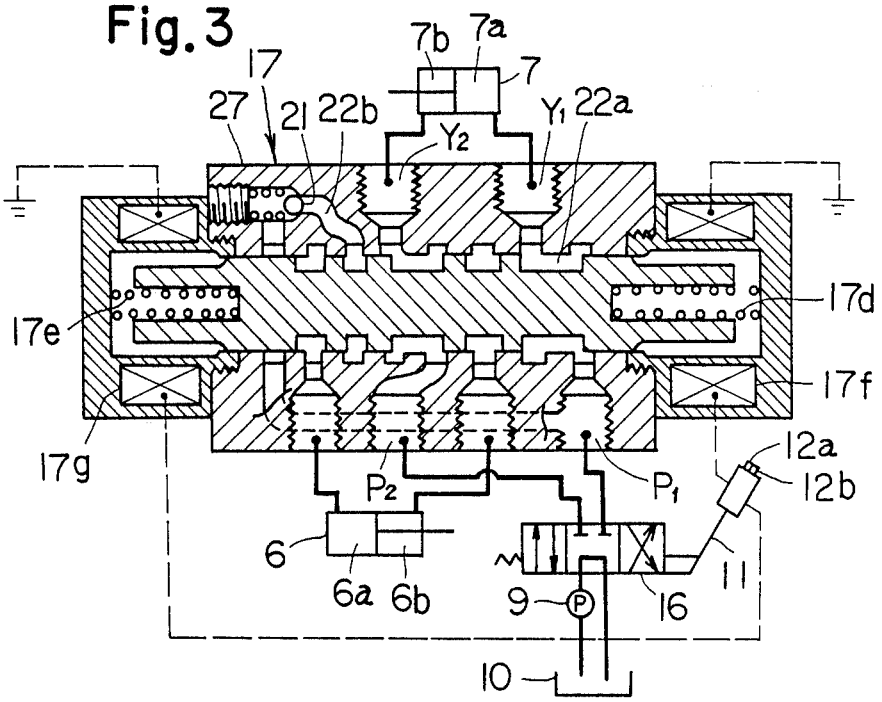

As shown in FIG. 1 through FIG. 3, this embodiment adopts the present invention for operating hydraulically an arm cylinder 6 and a bucket cylinder 7 of a front loader 2 which is detachably equipped to an agricultural tractor.

In FIG. 1 a front loader 2 is constructed so that a lift arm 3 is adapted to be driven ascendantly and descendantly by the arm cylinder 6, and a bucket 4 is adapted to be driven by the bucket cylinder 7 so as to take an angle of declination and elevation. Both arm cylinder 6 and bucket cylinder 7 are selectively connected to an oil-hydraulic pump 9 through a directional control valve 16, a self-sealing coupling 31 and an actuator selective valve 17 arranged in series thereto. The cylinder 6 or 7, which is selected in an alternative way by the actuator selective valve 17, is controlled to be driven extendedly and retractedly by the directional control valve 16. The directional control valve 16 is attached to the agricultural tractor, and the actuator selective valve 17 is attached to the front loader 2.

The directional control valve 16 comprises a solenoid operated type spring centered threeposition valve provided with a neutral position 16*a*, an extensional position 16B and a retractive position 16C.

The directional control valve 16 is adapted to be operated by a control lever 11. When the control lever 11 is set to a neutral position, the directional control valve 16 is kept in the neutral position 16A by means of springs 16*d*, 16*e*. When the lever 11 is set to the right side in FIG. 1, an extensional switch 13*b* is changed on so as for the valve 16 to be changed over to the extensional position 16B by an extensional solenoid 16*f* supplied with a power from a battery 14. When the lever 11 is set to the left side, a retractive switch 13*c* is changed on so as for the valve 16 to be changed over to the retractive position 16C by the retractive solenoid 16*g*.

The actuator selective valve 17 comprises a solenoid operated type spring centered three-position valve provided with an arm cylinder selective position 17A, a bucket cylinder selective position 17B and a bucket cylinder quick extensional position 17C.

The actuator selective valve 17 is adapted to be operated by a pair of switches 12*a*, 12*b* provided on the grip of the control lever 11. When neither of switches 12*a*, 12*b* are operated, the actuator selective valve 17 is kept in the bucket cylinder selective position 17B by means of springs 17*d*, 17*e*. When the arm operational switch 12*a* at the right side in FIG. 1 is changed on, the valve 17 is changed over to the arm cylinder selective position 17A by an arm operational solenoid 17*f*. When the quick extensional switch 12*b* at the left side is changed on, the valve 17 is changed over to the quick extensional position 17C by a quick extensional solenoid 17*g*.

In the quick operational position 17C there are provided with a pressure oil passage 22*a*, a return oil confluent passage 22*b* and a check valve 21. The pressure oil passage 22*a* connects an extensional pressure port P1 of the valve 17 to an extension-operational port Y1. The return oil confluent passage 22*b* connects a retract operational port Y2 to the pressure oil passage 22*a*. The check valve 21 is interposed in the return oil confluent passage 22*b*. Therefore, the quick extensional position 17C connects the extensional pressure port P1 of the actuator selective valve 17 to the bottom side oil chamber 7*a* of the bucket cylinder 7 through the pressure oil passage 22*a* and the extension-operational oil passage 27, and also connects the head side oil chamber 7*b* thereof to the bottom side oil chamber 7*a* through the retract-operational oil passage 28, the return oil confluent passage 22*b*, the check valve 21, the pressure oil passage 22*a* and the extension-operational oil passage 27 to block the retractive pressure port P2.

FIG. 2 and FIG. 3 are sectional views of the concrete construction of the actuator selective valve 17 respectively. The valve 17 shown in FIG. 2 is provided with the check valve 21 of the quick extensional position 17C disposed within the spool 20. On the other hand, the valve 17 shown in FIG. 3 is provided with the check valve 21 thereof disposed within the valve casing 27.

Further, in FIG. 1 the symbols 32,33,34 and 37 show relief valves. The relief valve 32 releases an abnormal pressure in the head side oil chamber 7*b* of the bucket cylinder 7 to the extension-operational oil passage 27 through the retract-operational oil passage 28. The relief valve 33 releases an abnormal pressure in the bottom side oil chamber 6*a* of the arm cylinder 6 to the extension-operational oil passage 27 of the bucket cylinder 7 through the extension-operational oil passage 35 of the arm cylinder 6. The relief valve 34 releases an abnormal pressure in the head side oil chamber 7*b* of the bucket cylinder 7 or an abnormal pressure in the bottom side oil chamber 6*a* of the arm cylinder 6 to the oil reservoir 10 through the extension-operational oil passage 36 of the directional control valve 16 by operating at the same time with the relief valve 32 or the relief valve 33. The relief valve 37 releases an abnormal pressure in the head side oil chamber 6*b* of the arm cylinder 6 to the bottom side oil chamber 6*a* thereof through the retract-operational oil passage 38 and the extension-operational oil passage 35.

Then, the function thereof is to be described hereinafter. First of all, when the arm operational switch 12*a* is changed on, the arm operational solenoid 17*f* becomes operative and then the actuator selective valve 17 is set to the arm cylinder selective position 17A to select the arm cylinder 6 for operation. While keeping that condition, when the control lever 11 is tilted to the right side, the extensional solenoid 16*f* becomes operative to set the directional control valve 16 to the extensional position 16B. Thereupon, the pressure oil discharged from the oil-hydraulic pump 9 is introduced to the bottom side oil chamber 6*a* of the arm cylinder 6 to extend the arm cylinder 6 for lifting the arms 3. When the control lever 11 is tilted to the left side the other way for the retractive solenoid 16*g* to be operated, the directional control valve 16 is changed over to the retractive position 16C and the pressure oil is introduced to the head side oil chamber 6*b* so as for the arm cylinder 6 to be retracted for lowering the arms 3.

Then when both arm operational switch 12*a* and quick extensional switch 12*b* are changed off, the actuator selective valve 17 is changed over to the bucket cylinder selective position 17B by means of springs 17*d*,17*e*. While keeping that condition, when the control lever 11 is tilted to the right side for the directional control valve 16 to be changed over to the extensional position 16B, the pressure oil is introduced to the bottom side oil chamber 7*a* of the bucket cylinder 7 so as for the bucket cylinder 7 to be extended for swinging the bucket 4 towards the dump side thereof. When the control lever 11 is tilted to the left side on the other way for the valve 16 to be changed over to the retractive position 16C, the pressure oil is introduced to the head side oil chamber 7*b* thereof for the bucket cylinder 7 to be retracted for swinging the bucket 4 towards the scoop side thereof. And then when the quick extensional switch 12*b* is changed on for the quick extensional solenoid 17*g* to be operated, the actuator selective valve 17 is changed over to the quick extensional position 17C. While keeping that condition, when the control lever 11 is tilted to the right side for the directional control valve 16 to be changed over to the extensional position 16B, the pressure oil is introduced to the bottom side oil chamber 7*a* and also the return oil from the head side oil chamber 7*b* is introduced to the bottom side oil chamber 7*a* as the confluent pressure oil. Therefore the bucket cylinder 7 is extended quickly and the bucket 4 is swung quickly towards the dump side.

Further, it is known that the front loader 2 is operated with the front wheels of the tractor being raised from the ground by thrusting the bucket 4 onto the ground as one kind of operation of the front loader 2. Even if the actuator selective valve 17 happens to be changed over to the quick extensional position 17C due to a mistake touch to the quick extensional switch 12*b*, the check valve 21 prevents the operative pressure oil in the bottom side oil chamber 7*a* of the bucket cylinder 7 from flowing to the head side oil chamber 7*b* through the quick extensional position 17C. Therefore, the blocking of the bucket cylinder 7 functions to ward off such a danger that the raised front portion of the tractor suddenly falls.

Moreover, among some operations of the front loader 2 there exist such operations that the tractor is driven ahead with its bucket 4 thrusted onto the ground while excavating it, and that the tractor dashes toward a hard wall with its bucket 4 kept horizontal. But those operations have the problem that some components might be deformed or broken due to a very large impact load acted upon the front loader 2 and the pressure oil circuits. In order to solve the problem there is provided with relief valves 32,33 and 34. Generally such an impact load is observed as an abnormal pressure such as a large impact pressure or a surging pressure which acts upon the head side oil chamber 7*b* of the bucket cylinder 7 or the bottom side oil chamber 6*a* of the arm cylinder 6. But according to this embodiment, since the abnormal pressure can be absorbed by the relief valves 32,34 or 33,34, the impact load can be also absorbed so as to prevent the front loader 2 and the pressure oil circuit from being deformed or broken.

And even though an abnormal impact load is apt to be generated in such operations as an abrupt changeover from lowering of the arm 3 to a scoop-operating of the bucket 4, a wall digging by swinging the bucket 4 towards the scoop side thereof and a ground readjustment by driving the tractor ahead with the bucket thrusted onto the ground, the abnormal impact load can be also absorbed by the relief valves 32,34 or 33,34.

Furthermore, in case that the bucket 4 strikes against a stone on the earth or roots of a tree while the tractor is backing for a ground readjustment or for an earth-moving on the condition that the front wheels are raised from the ground with the arms 3 lowered and the bucket 4 thrusted onto the ground, an abnormal pressure is apt to be generated in the bottom side oil chamber 7*a* of the bucket cylinder 7 and in the head side oil chamber 6*b* of the arm cylinder 6. The abnormal pressure in the head side oil chamber 6*b* can be absorbed by the operation of the relief valve 37.

No. 2 EMBODIMENT

Figure 4:
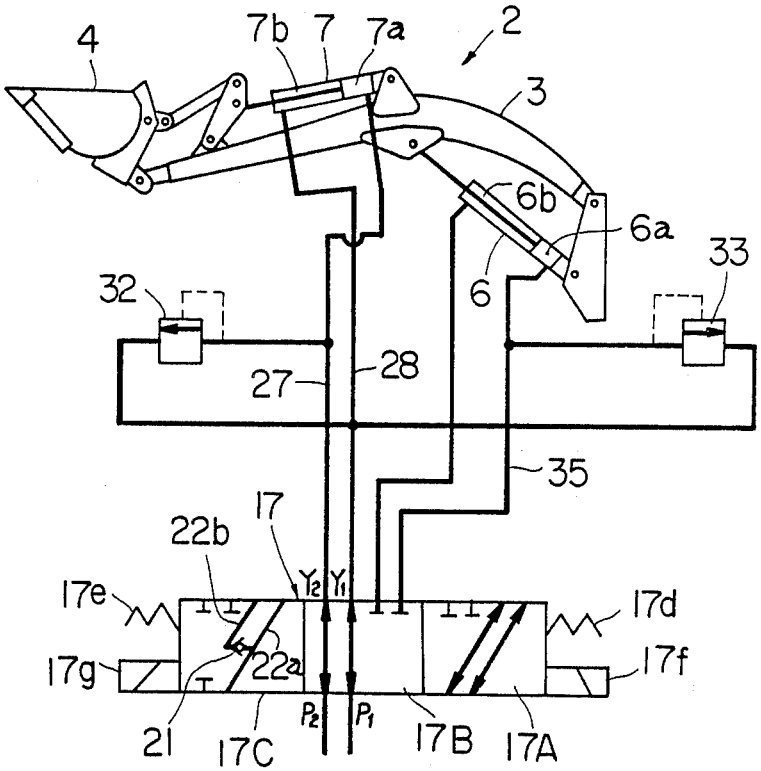
FIG. 4 is an oil-hydraulic circuit diagram showing a principal part of the No. 2 embodiment of the present invention.

As shown in FIG. 4 this embodiment is constructed so that the arm cylinder 6 can be extended quickly by the quick extensional position 17C of the actuator selective valve 17 instead of the bucket cylinder 7 extended quickly thereby in the construction of No. 1 embodiment. Accordingly, the lift arms can be lifted quickly under the conditions of no load and a light load thereof.

On the other hand, it may be understood that the check valve 21 is omissible from the construction shown in FIG. 4. In the case of the omission of the check valve, a so-called floating operation wherein the arms 3 are swung up and down freely with the bucket 4 following the ground can be performed during the tractor running by setting the directional control valve 16 to the neutral position 16A and also setting the actuator selective valve to the quick extensional position 17C selectively so as to connect the bottom side oil chamber 6*a* to the head side oil chamber 6*b* through the quick extensional position 17C.

Furthermore, as shown in FIG. 4 an abnormal pressure in the bottom side oil chamber 6*a* of the arm cylider 6 and in the bottom side oil chamber 7*a* of the bucket cylinder 7 is adapted to be released to the retract-operational oil passage 28 of the bucket cylinder 7 by the each operation of the relief valves 32,33 by connecting the extension-operational oil passage 27 of the bucket cylinder 7 to the operational port Y2 at the left side of the actuator selective valve 17 and also connecting the retract-operational oil passage 28 to the operational port Y1 at the right side.

When the bucket 4 strikes against a stone on the earth or roots of a tree while the tractor is backing with the bucket 4 thrusted onto the ground, an abnormal pressure is apt to be generated in the bottom side oil chamber *7a* of the bucket cylinder 7. The abnormal pressure can be absorbed by the operation of the relief valve 32.

No. 3 EMBODIMENT

Figure 5:
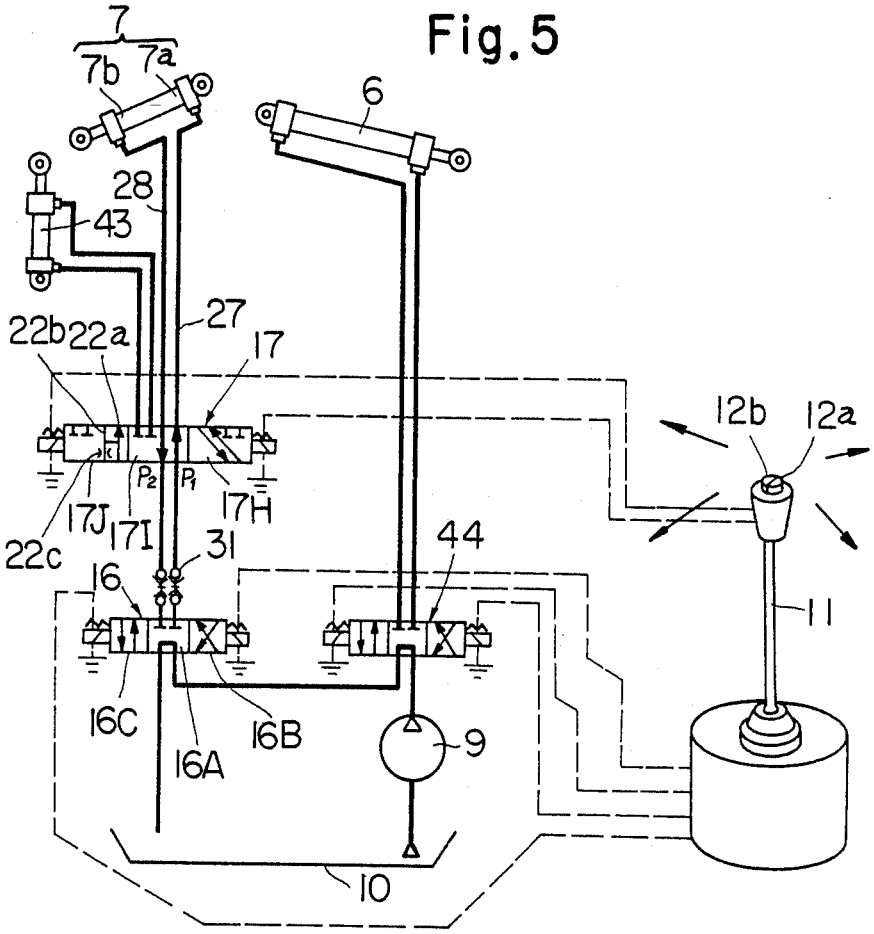
FIG. 5 is an oil-hydraulic circuit diagram showing the No. 3 embodiment of the present invention.
Figure 6:
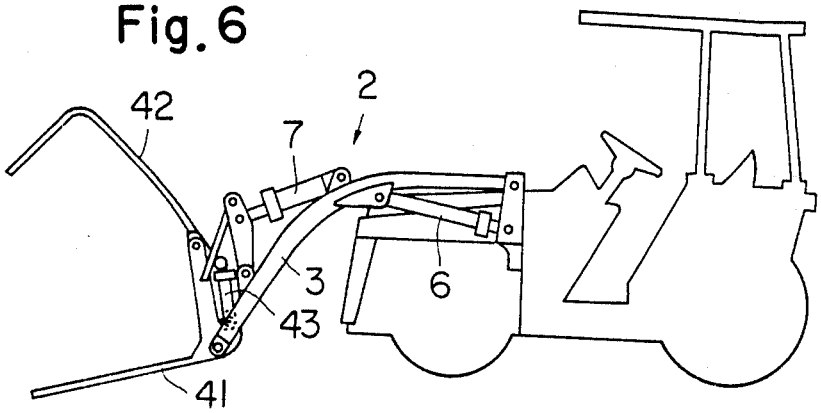
FIG. 6 is a side view showing a tractor equipped with a front loader and a grapple manurefork.

As shown in FIG. 5 and FIG. 6 this embodiment is constructed by changing a portion of the construction of the No. 1 embodiment as follows. That is, at the front ends of the arms 3 a grapple manure-fork 41 is attached instead of the bucket 4. The grapple manure-fork 41 is adapted to be operated swingably by the bucket cylinder 7, and the grapple tine 42 is operatively opened and closed by the grapple cylinder 43.

The oil-hydraulic pump 9 is connected to the No. 1 directional control valve 44 and the No. 2 directional control valve 16 in series. The No. 1 directional control valve 44 functions to control the extension and the retraction of the arm cylinder 6. The No. 2 directional control valve 16 functions to control the extension and the retraction of the bucket cylinder 7 and the grapple cylinder 43. The No. 2 directional control valve 16 is adapted to be connected selectively to the bucket cylinder 7 and to the grapple cylinder 43 through the self-sealing coupling 31 and the actuator selective valve 17. The actuator selective valve 17 can be changed over to the grapple selective position 17H, to the bucket selective position 17I and to the quick extensional position 17J. The grapple cylinder selective position 17H functions to select the grapple cylinder 43, the bucket cylinder selective position 17I functions to select the bucket cylinder 7 and the quick extensional position 17J functions to extend the bucket cylinder 7 quickly.

The quick extensional position 17J is provided with a pressure oil passage **22*a*, a return oil confluence passage 22*b* and a throttle passage 22*c*. During the quick extension of the bucket cylinder 7** the return oil displaced from the head side oil chamber *7b* thereof is introduced to the return oil confluence passage **22*b* and a portion of the return oil is released to the retractive pressure port P2 from the throttle passage 22*c* and then returned to the oil reservoir 10. But the remains of the return oil is introduced to the pressure oil passage 22*a*** and then supplied to the bottom side oil chamber *7a* as the confluent flow.

The throttle passage **22*c* regulates the quick extensional speed of the bucket cylinder 7 by returning a portion of the return oil to the oil reservoir 10**.

No. 4 EMBODIMENT

Figure 7:
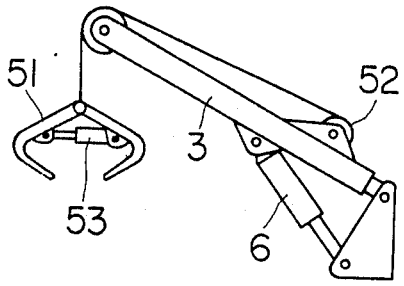
FIG. 7 is a side view of a manure-grab showing the No. 4 embodiment of the present invention.

As shown in FIG. 7 the No. 4 embodiment is constructed by changing a portion of the construction of the No. 3 embodiment as follows. That is, at the front end of the arms 3 the manure-grab 51 is attached suspendedly instead of the grapple manure-fork 41. The oil-hydraulic circuit shown in FIG. 5 is used for this embodiment. The grapple cylinder 43 is replaced with the motor 52 for hoisting the manure-grab 51, and the bucket cylinder 7 is replaced with the cylinder 53 for opening and closing the manure-grab 51. Therefore, the grab operative cylinder 53 can be extended quickly by the quick extensional position 17J so as for the manure-grab 51 to be opened quickly.

No. 5 EMBODIMENT

Figure 8:
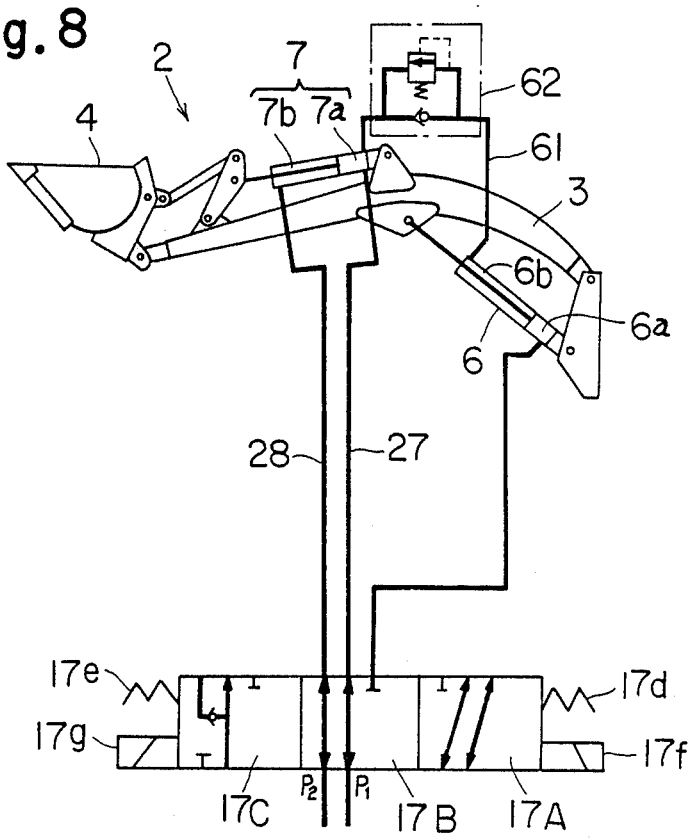
FIG. 8 is an oil-hydraulic circuit diagram showing a principal part of the No. 5 embodiment of the present invention.

As shown in FIG. 8 this embodiment is constructed by changing a portion of the construction of the No. 1 embodiment as follows. That is, the retract-operational oil passage 61 connected to the head side oil chamber **6*b* of the arm cylinder 6 is not connected to the actuator selective valve 17** but connected to the bottom side of the oil chamber *7a* of the bucket cylinder 7 so as to communicate with the extension-operational oil passage 27 of the bucket cylinder 7 therethrough. Therefore, since the retract-operational oil passage 61 of the arm cylinder 6 is managed without being connected to the actuator selective valve 17, the number of the connections to the valve 17 is reduced by one and the construction of the valve 17 is simplified.

On the other hand, the inter-pilot type counterbalance valve 62 is interposed in the retract-operational oil passage 61. The counterbalance valve 62 functions to impose a back pressure to the head side oil chamber 6b. Therefore, during the retraction of the bucket cylinder 7 the arm cylinder 6 is prevented from being extended by an external force.

For example, when the bucket cylinder 7 is retracted by changing over the actuator selective valve 17 to the bucket selective position 17B and then the directional control valve 16 to the retractive position 16C under the condition that the front wheels of the tractor are raised above the earth by lowering the arms 3, the following problem is raised in the oil-hydraulic circuit which is not provided with the counterbalance valve 62. That is, the gravities of the tractor and the front loader 2 act as the force for extending the arm cylinder 6. Since the force displaces the operative pressure oil in the head side oil chamber **6*b* to the oil reservoir 10 through the oil passage 61,27 while forming the vacuum space in the bottom side oil chamber 6*a*, the arm cylinder 6** is extended. Therefore, the front portion of the tractor falls and it is impossible to keep the front wheels raised above the earth.

Accordingly, the counterbalance valve 62 prevents the arm cylinder 6 from being extended by the gravities of the tractor and the front loader 2 by imposing the back pressure to the bottom side oil chamber **6*b***.

No. 6 EMBODIMENT

Figure 9:
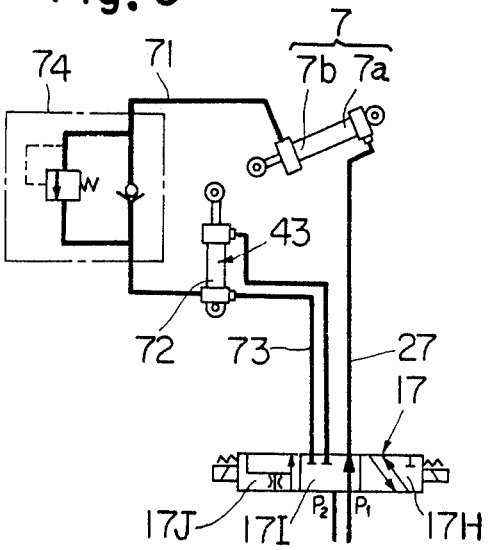
FIG. 9 is an oil-hydraulic circuit diagram showing a principal part of the No. 6 embodiment of the present invention.
Figure 10:
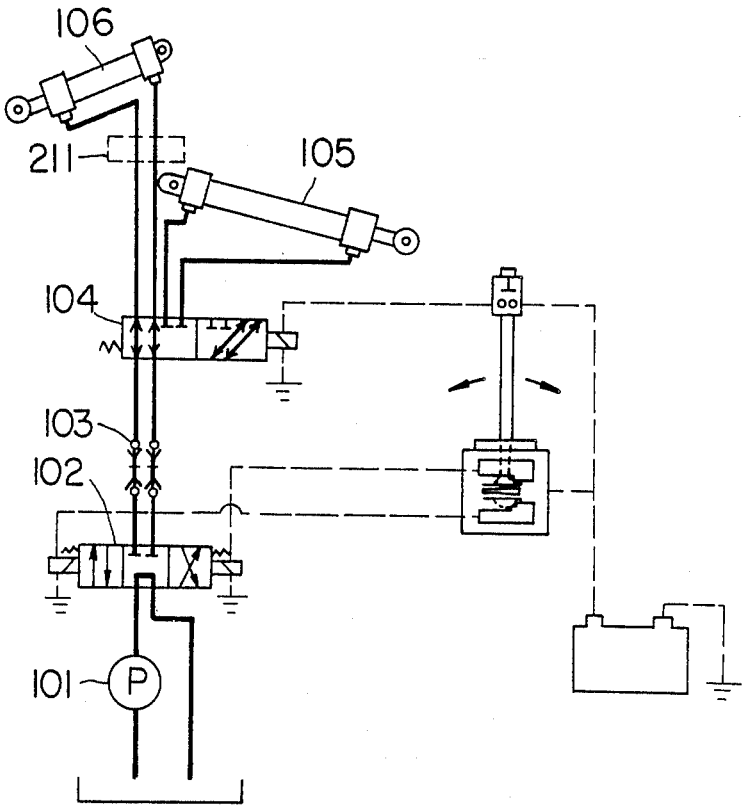
FIG. 10 is an oil-hydraulic circuit diagram showing No. 1 related technology wherein plural kinds of oil-hydraulic actuators are selectively operable.
Figure 10:
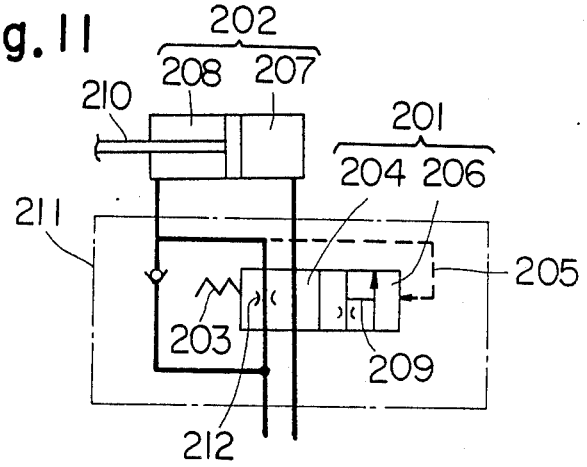

As shown in FIG. 9 this embodiment is constructed by changing a portion of the construction of the No. 3 embodiment. That is, the retract-operational oil passage 71 connected to the head side oil chamber *7b* of the bucket cylinder 7 is not connected to the actuator selective valve 17 but connected to the bottom side oil chamber 72 of the grapple cylinder 43 so as to communicate to the extension-operational oil passage 73 of the grapple cylinder 43. The counterbalance valve 74 which is interposed in the retract-operational oil passage 71 is adapted to impose a back pressure to the head side oil chamber *7b* of the bucket cylinder 7.

The counterbalance valve 74 operates in the same way as the counterbalance valve 62 in the No. 5 embodiment, and prevents the fork 41 from dumping a cargo owing to the extension of the bucket cylinder caused by the gravity of the cargo on the fork 41 when the grapple tine 42 is opened by retracting the grapple cylinder 43.

We claim:

1. A selective control device for plural kinds of oil-hydraulic actuators, comprising a directional control valve and an actuator selective valve, said actuator selective valve for selecting an operative oil-hydraulic actuator from among plural kinds of oil-hydraulic actuators adapted to be selectively connected to an oil-hydraulic pump through said directional control valve and said actuator selective valve arranged in series with said directional control valve so that the said operative oil-hydraulic actuator selected by the actuator selective valve is operable by said directional control valve, and a preselected one of the oil-hydraulic actuators including an oil-hydraulic cylinder, said actuator selective valve being provided with selective positions and a quick extensional position, said quick extensional position for quick extension operation of the oil-hydraulic cylinder of the preselected one of the oil hydraulic actuators, said selective positions corresponding to each of said plural kinds of oil-hydraulic actuators, said quick extensional position communicating an extensional pressure port of said actuator selective valve to a bottom side oil chamber of said oil-hydraulic cylinder and also communicating a head side oil chamber thereof to said bottom side oil chamber.

2. A selective control device for plural kinds of oil-hydraulic actuators according to claim 1, wherein said quick extensional position has a pressure oil passage and a return oil confluence passage, said pressure oil passage connects the extension pressure port of the actuator selective valve to an extensional operative port, and said return oil confluence passage connects an operative port for retraction to the pressure oil passage.

3. A selective control device for plural kinds of oil-hydraulic actuators according to claim 2, wherein a check valve is disposed in the return oil confluence passage of said quick extensional position, and said check valve blocks a backward flow of the pressure oil from the pressure oil passge to the return oil confluence passage.

4. A selective control device for plural kinds of oil-hydraulic actuators according to claim 2, wherein said quick extensional position allows for the pressure oil to flow backward from the pressure oil passage to the return oil confluence passage.

5. A selective control valve for plural kinds of oil-hydraulic actuators according to claim 2, wherein said quick extensional position blocks a retractive pressure port of the actuator selective valve.

6. A selective control device for plural kinds of oil-hydraulic actuators according to claim 2, wherein said quick extensional position has a throttle passage, and said throttle passage allows for a portion of the return oil flowing through the return oil confluence passage to escape to the retractive pressure port.

7. A selective control device for plural kinds of oil-hydraulic actuators according to claim 1, wherein said plural kinds of actuators are ones for operating a front loader equipped to an agricultural tractor, and said specific oil-hydraulic cylinder is a bucket cylinder.

8. A selective control device for plural kinds of oil-hydraulic actuators according to claim 1, wherein between said directional control valve and said actuator selective valve there are provided connectors.

9. A selective control device for plural kinds of oil-hydraulic actuators according to claim 1, wherein said actuator selective valve is operatively located intermediate of said plural actuators and said directional control valve.

* * * * *